US007194836B1

(12) United States Patent
Urban

(10) Patent No.: US 7,194,836 B1
(45) Date of Patent: Mar. 27, 2007

(54) GUN ATTACHMENT METHOD AND APPARATUS

(76) Inventor: Brian Urban, 8807 Vinnup Rd., Lynden, WA (US) 98264

( * ) Notice: Subject to any disclaimer, the term of this patent is extended or adjusted under 35 U.S.C. 154(b) by 0 days.

(21) Appl. No.: 10/984,447

(22) Filed: Nov. 8, 2004

Related U.S. Application Data

(60) Provisional application No. 60/518,232, filed on Nov. 7, 2003.

(51) Int. Cl.
*F41C 3/14* (2006.01)

(52) U.S. Cl. ..... 42/60; 42/90; 42/70.07; 42/106; 42/85; 42/96; 89/14.05; 89/14.2; 89/14.3; 89/14.4

(58) Field of Classification Search ..... 89/14.05, 89/14.2, 14.3, 14.4; 42/106, 85, 90, 96
See application file for complete search history.

(56) References Cited

U.S. PATENT DOCUMENTS

| | | | | |
|---|---|---|---|---|
| 3,191,330 A | | 6/1965 | Olson | |
| 4,418,487 A | * | 12/1983 | Strahan | 42/125 |
| 4,691,614 A | | 9/1987 | Leffel et al. | |
| 4,811,648 A | | 3/1989 | Blackwell et al. | |
| 4,852,460 A | | 8/1989 | Davidson | |
| 5,107,612 A | * | 4/1992 | Bechtel | 42/115 |
| D328,632 S | | 8/1992 | Bigwood | |

OTHER PUBLICATIONS www.gggaz.com/products/afb.php □□GG&G Alternative Force Block, Nov. 2, 2002, ~ According to Wayback Machine.org.*
Publication: 3rd Generation Glock CQB Standoff Internet web page, Oct. 25, 2004, 2 pages, Published by: Target Masters Training Academy, USA.
Publication: SureFire Classic 610R Handgun WeaponLight, Internet web page, Oct. 25, 2004. 1 page, Published by SureFire, Fountain Valley, CA.

* cited by examiner

*Primary Examiner*—Michael J. Carone
*Assistant Examiner*—Gabriel J. Klein
(74) *Attorney, Agent, or Firm*—Michael F. Hughes; Hughes Law Firm, PLLC

(57) ABSTRACT

A gun attachment adapted to fit to the subframe of a handgun and mount to a laterally extending member which can be a modified laterally extending member to extend beyond the lateral surfaces of the subframe, whereby an extension member which moves with respect to a base member applies a force to the trigger guard of the subframe, thereby creating a positive torque counteracted by engagement of a chamber region to the forward portion of the subframe whereby the gun attachment is rigidly attached to the subframe of the handgun without substantially modifying the same. The handgun attachment further comprises a forward member adapted to have load exerted thereon and transferring the load to the subframe and not to the slide, thereby maintaining the handgun in battery and allowing the handgun to be fired in a close quarter situation.

23 Claims, 9 Drawing Sheets

GUN ATTACHMENT METHOD AND APPARATUS

RELATED APPLICATIONS

This application claims priority benefit of U.S. Ser. No. 60/518,232 filed Nov. 7, 2003.

BACKGROUND OF THE INVENTION

Field of the Invention

Handguns are employed in various environments which generally require some sort of close quarter engagement with a combatant of some sort. By the nature of a handgun having a limited range with respect to a rifle, oftentimes a combatant is within a relatively close proximity to the operator of the handgun. In such tactical situations such as clearing a house, a law-enforcement officer may clear room to room approaching an unexpected environment where a combatant may be in close proximity to the officer. Because the handgun is generally extended outwardly from the officer toward the combatant, the closest object to the combatant is a front portion of the handgun which is particularly vulnerable with a slide operated semi-automatic handgun.

In general, slide operated semiautomatic handguns have become the standard for law enforcement due to their higher round capacity, quicker firing having a higher rate of fire, and for other reasons such as lower trigger pull weight as compared to the traditional revolvers. Semiautomatic handguns have become increasingly reliable and a preferred sidearm of choice for many agencies. However, one particular vulnerability of slide operated handguns is that if the slide repositions rearwardly with respect to the subframe and renders the firearm out of battery where the firearm will not fire. This can occur when a combatant (or other object) imparts a force upon the slide of the handgun in very close combat situations.

Strike plates are known in the prior art to have a forward plate that is adapted to impart energy from an impact to the subframe and hence keep the slide free from any direct external contact from the forward portion of the handgun.

In many handguns, a strike plate must be added by attaching a strike plate mechanism to the forward lower portion of the subframe of the handgun which often times is not intended to have such a load imparted thereon. The normal prior art method of attaching a strike plate is to drill a plurality of holes through the forward lower portion of the subframe which generally must be done by a competent gunsmith and thereafter attach a strike plate attachment thereto the subframe with screws. Of course this is very costly and oftentimes undesirable, in that the strike plate is permanently attached to the handgun, and further, the handgun must be sent to a competent gunsmith. In general, gunsmiths are not known for their punctuality of completing their work and timely returning firearms to their owners. This is particularly problematic for a duty firearm that the law-enforcement officer is familiar with and the officer does not want to be without their firearm for any extended period of time.

An additional issue with handguns is that a majority of shootings occur at night or in low light situations. Therefore, it is desirable to have light attachments retrofitted to handguns; this practice is becoming an increasingly popular option in modern handguns. One form of connecting a light to a handgun is by fitting a picatinny rail system-type light to a corresponding picatinny rail of the handgun. A few modern handguns have a picatinny rail system built-in to the subframe for this purpose. However, a vast majority of the handguns do not have a fixture for mounting a light thereto. One prior art system of mounting a light to a handgun incorporates mounting the light to a laterally extending crosspin; however, in this configuration, the light is fixedly attached to the handgun and cannot be removed without removing the laterally extending pin which renders the firearm inoperable until the pin is reinserted. In the case of mounting the light to the handgun, it is not feasible for the possessor of the handgun to render the handgun inoperable for a period of time by removing the laterally extending pins to retrofit the light to the handgun in a real-life and tactical scenario. This confrontational scenario would require for a quick attachment of a light to the handgun for operation or detachment of the light. Further, in situations where one light may have to operate on more than one firearm, it is very advantageous to be able to quickly position the light onto say, for example, a rifle, such as an M4 rifle, and in a rather expedient manner, fit the light to a handgun while all of the weapons are operational and such switching of the light can be accomplished with minimal effort and training. This is particularly advantageous for scenarios in the field where operatos desire to take the least amount of equipment into the field and get as much dual purpose use as possible out of the equipment. Therefore an operator can take one light (and perhaps a backup as he sees fit) and have it mount to a handgun as well as multiple firearms.

The prior art method of attaching a light to a subframe using the laterally extending crosspin does not incorporate any load transmission thereto the subframe and the slide is susceptible of being knocked out of battery. Further, such a retrofitting technique of mounting a light cannot be employed with the prior art method of attaching a strike plate because the dimensions of the skide plate and light are not such to allow both items to be simultaneously attached to the handgun.

The prior art method of attaching the strike plate as described above is fundamentally flawed because the attachment primarily is predicted upon the strength of the forward lower portion of the subframe (referred to the dust cover in some models) which traditionally is not designed to handle such a load being imparted thereon as previously discussed. Normally, the dust cover (or the forward lower portion of the handgun) is potentially the weakest portion of the handgun. Further, if a load is imparted on the forward lower portion of the subframe to bend the forward lower portion of the subframe, the firearm may become inoperable.

However, imparting the load from a strike-plate-like surface to the rearward portion of the firearm has the added and unexpected capability of imparting a portion of the load exerted upon the forwardmost portion of the gun attachment to a laterally extending member. This improvement has the added functionality in one form of imparting the load to a pin whereby the strength of material of the laterally extending pin and hardness is such that if the imparted load upon the gun attachment is excessive, the laterally extending pin will shear and not bend. This is particularly useful in that the firearm is still functional when the laterally extending pin extends through the central region of the handgun and maintains the relationship of the various components that engage the pin. This functionality is maintained even if the outwardly protruding lateral portions of the pin are sheared off. When this occurs, the strike plate will fall off from the firearm; however, the firearm will remain functional.

SUMMARY OF THE INVENTION

The present invention is a gun attachment adapted to be fitted to a handgun having a vertical, longitudinal and lateral axis, a subframe and a slide. The handgun has a laterally extending member and a trigger guard. The gun attachment comprises a locking system having an extension member, such as a set screw in one form, having a forward surface that is adapted to engage the trigger guard of the handgun, a slotted surface defining an open region adapted to engage the subframe of the handgun, and a forward member extending vertically having a forward engagement surface adapted to have an external force applied thereto and transfer the energy of said force to the subframe of the handgun. The extension member such as a set screw in one form is adapted to move with respect to the base region and forcefully engage the trigger guard to provide a positive movement whereby the slotted surface forcefully engages the subframe and the gun attachment adapted to be rigidly attached to the handgun.

DETAILED DESCRIPTION OF THE PREFERRED EMBODIMENTS

Figure 1:
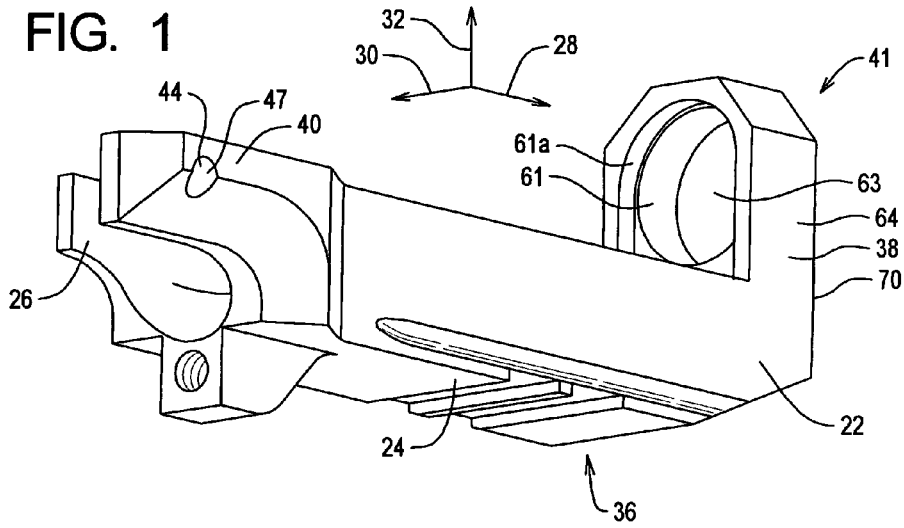
FIG. 1 shows an isometric view of the base member which is a component of the gun attachment.

As shown in FIG. 1, there is a base member 41 that is a portion of the handgun attachment 20. In general, the hand gun attachment 20 comprises a forward region 22, a central region 24 and a rearward region 26. To assist in describing the handgun attachment, an axes system is defined whereby the arrow indicated at 28 indicates the longitudinal axis and the arrow 30 indicates a lateral axis. Finally, arrow 32 indicates a vertical axis.

Figure 2:
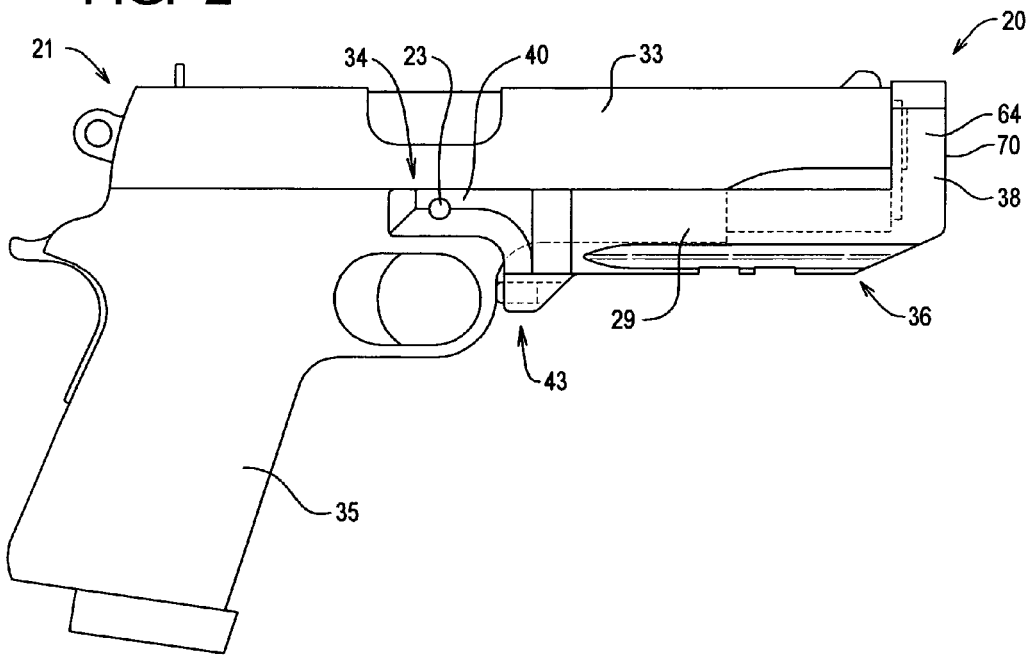
FIG. 2 is a side view of a firearm with the gun attachment attached thereto showing the forward lower portions of the firearm in a hidden hatched line.

The gun attachment 20 as shown in FIG. 1 in one form comprises a base member 41 and as seen in FIG. 2 further comprises a laterally extending member 23 and a locking system 43.

In general, the gun attachment 20 is adapted to mount to a firearm, specifically a handgun and more specifically a slide-operated handgun such as a semiautomatic handgun or a double action only handgun 21 as shown in FIG. 2. In general, the handgun 21 comprises a slide region 33 and a subframe 35. The subframe 35 has a forward portion where a forward lower portion of the subframe 29 is located. The handgun 21 has a laterally extending member 23 that is used to retrofit the base member 41 thereto. The attachment process is described in detail following a description of the gun attachment 20.

As shown in FIG. 2, the gun attachment 20 comprises a mounting region 34, an attachment region 36 and a reinforcement region 38. These regions are discussed in detail below.

Figure 9:
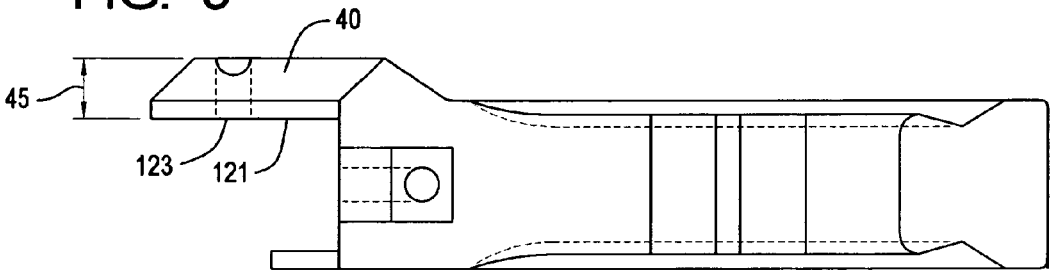
FIG. 9 is a bottom view of the base member.

The mounted region 34 is adapted to mount to an existing slide-operated handgun. The preferred form of mounting the attachment 20 to a handgun is to employ a laterally extending opening adapted to have the laterally extending member such as a structure extend therethrough. The original laterally extending pin is replaced by a slightly longer member 23 that extends into the shoulder region 40 by a distance 45 that is generally between ⅛ to ½ of an inch as indicated in FIG. 9. In general, the thickness of the shoulder region as shown in FIG. 9 should be such to have sufficient strength and rigidity to allow the base member 42 to be firmly fitted and rigidly attached to the handgun 21. It is important to note that in a handgun such as that by Sigarms® or other firearms, the laterally extending member can have a threaded portion that is exposed to the lateral portion of the subframe whereas another engagement member can engage the threaded portion to provide the circular surface for engagement of the attachment region of the strike plate. It should further be noted that the laterally extending member does not have to have a circular or cylindrical outer surface; it can be any type of surface, such as triangular, because the rotation about that medial region is quite minimal to engage the subframe.

Now referring back to FIG. 2, the apparatus 20 is mounted to a slide-operated pistol indicated at 21. A slide-operated pistol 21 comprises a laterally extending pin that is adapted to hold various components of the firearm together and allow for easy disassembly for routine maintenance and cleaning. As mentioned above, the member 23 is removed and replaced with a slightly longer pin that is adapted to extend through the firearm as well as through the shoulder region 40 of the mounting region 34. The shoulder region 44 comprises a surface 47 defining the opening 44 or otherwise referred to as the receiving portion as shown in FIG. 1 that is adapted to receive the member 23 or other laterally extending member of the handgun and exert a force thereon. The surface 47 which is one form of a receiving portion is adapted to receive a laterally extending member of the handgun and has a point of rotation which as shown in FIG. 1 is the center of the surface 47 which in one form is cylindrical.

Figure 5:
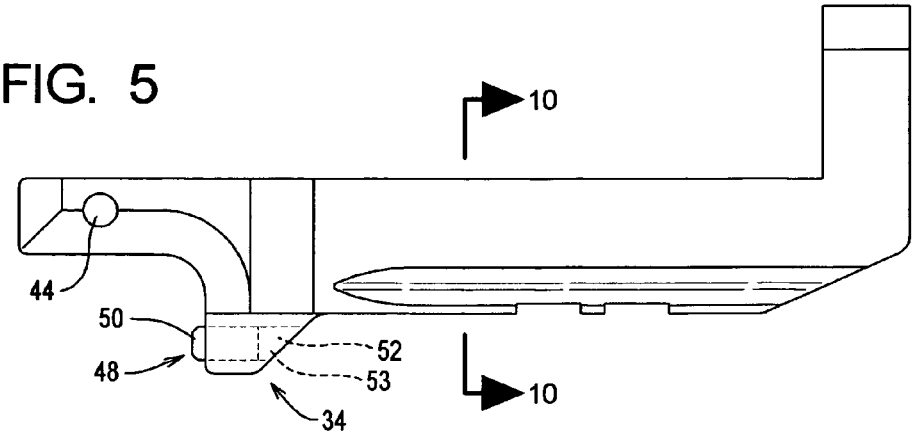
FIG. 5 shows a side view of the gun attachment without the laterally extending crosspin showing the shoulder region in the left-hand portion.

As shown in FIG. 5, the mounting region 34 further comprises an engagement portion 48. The engagement portion 48 in one form is comprised out of an extension 50 that is positioned vertically below the opening 44. The engagement portion 48 is comprised of an extension member 50 which in one form is a longitudinally extending set screw which is adapted to engage the threads of the opening 52 in the base member 41. In a preferred form, the screw has a countersunk head that is adapted to engage the interior portion 53 of the opening 52.

Figure 3:
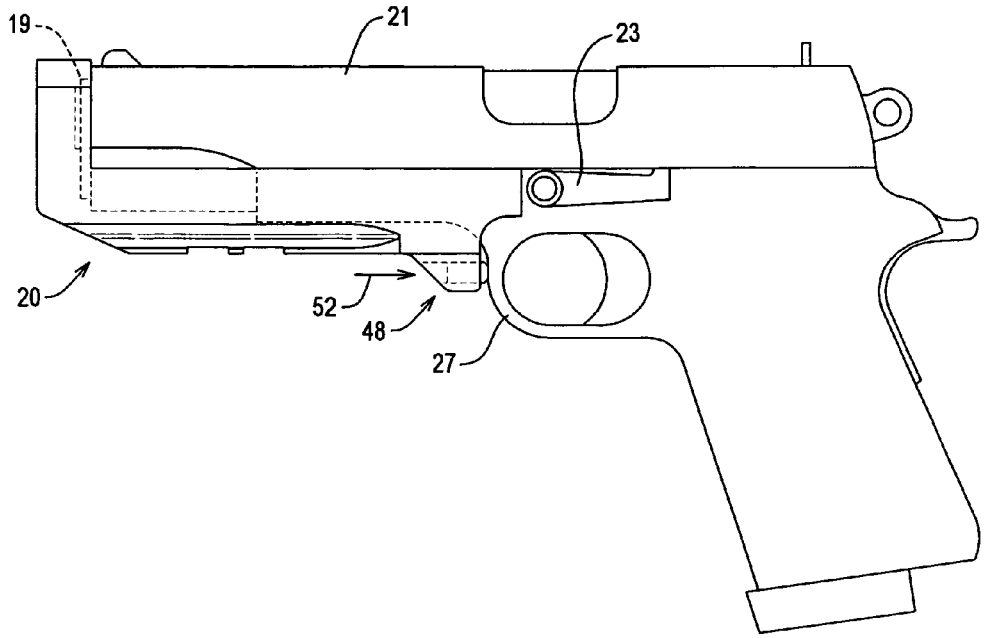
FIG. 3 is another side view of the gun attachment showing the laterally extending pin having an extension extending rearwardly similar to the stock firearm retention pin.
Figure 4:
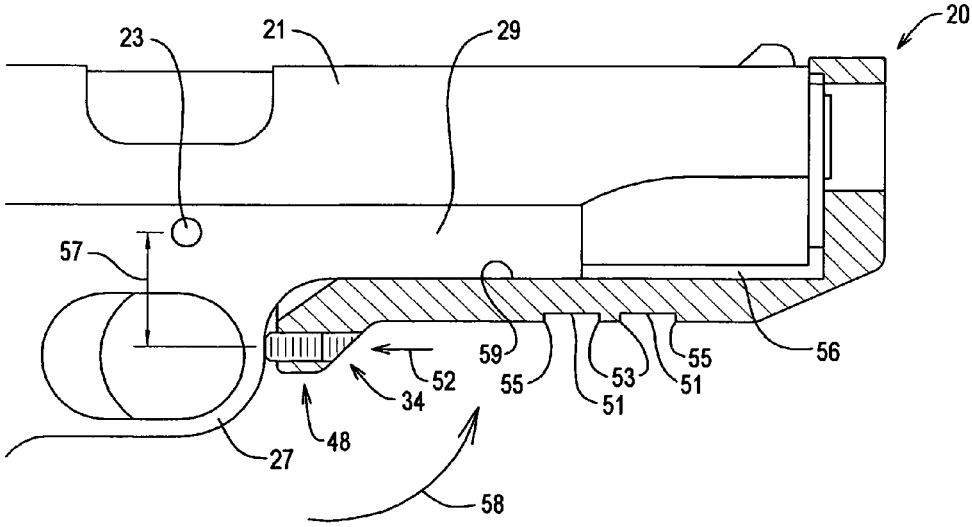
FIG. 4 is a partial sectional view of the gun attachment and further shows the force vector diagrams and illustrates the attachment mechanism exerting pressure upon the attachment of the base member to the subframe of the handgun.

Now referring to FIGS. 3 and 4, the gun attachment 20 is attached to the firearm 21. The member 23 extends through the firearm and provides the functionality that is inherent with the placement of the pin and further, the pin extends through the portion of the shoulders 40 to provide a first mounting region of the mounting system 34. Located vertically below the first mounting system, the engagement portion 48 engages the trigger guard 27 of the firearm 21. As shown in FIG. 4, because the engagement force indicated at 52 is vertically below the force exerted upon the firearm at the laterally extending member 23 by a distance indicated by 57, a moment is produced in the direction indicated by arrow 58 is produced. This moment (torque) provides a thrust force upon the lower portion of the forward lower portion of the subframe 29 from the chamber region 56 of the attachment 20.

Figure 7:
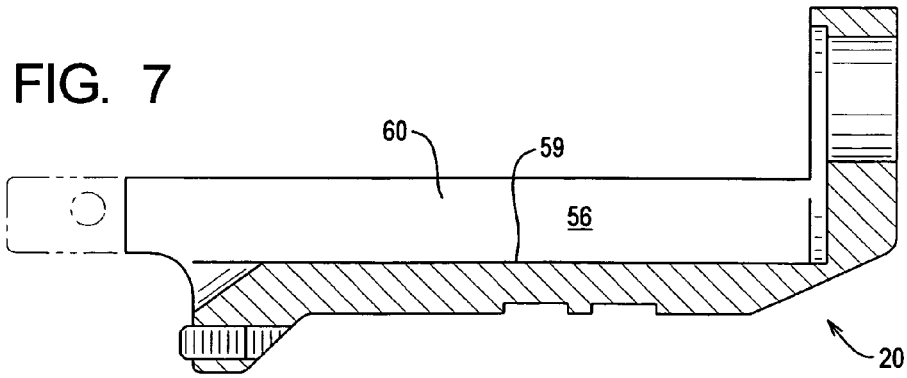
FIG. 7 is a cross-sectional view of the gun attachment and in particular the base member.

Now referring to FIG. 7, the gun attachment 20 further comprises a central chamber region 56. The chamber region 56 has a lower surface 59, a first lateral surface 60 and a second lateral surface 62 (see FIG. 8) opposite to surface 60 and not shown in FIG. 7. The chamber region 56 is adapted to house a forward lower portion of the subframe 29 of a firearm as shown in FIG. 4. The lower surface 58 is adapted to forcefully engage the lower surface of the forward lower portion of the subframe 29 as described below.

Figure 8:
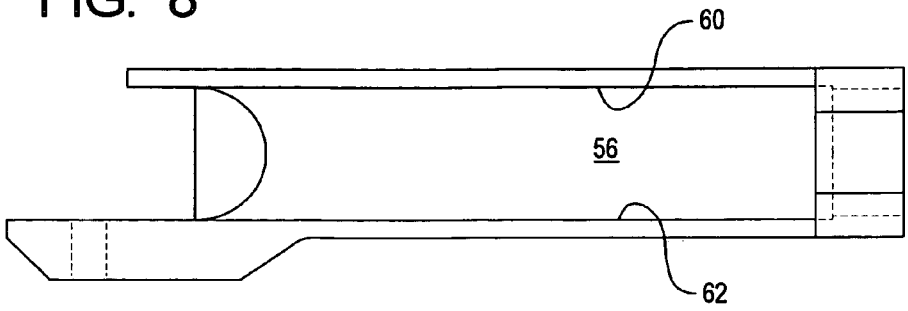
FIG. 8 is a top view of the base member.

Either one shoulder extension 40 (see FIG. 9) or two shoulder extensions can be employed where the pin extends through both shoulders for extra rigidity. As shown in FIG. 8, if one shoulder extension is employed, the opposing lateral inner surface 60 of the chamber region 56 imparts a force on the corresponding lateral surface of the forward lower portion of the subframe, adding extra stability to the device. This lateral force upon the inner surface of the chamber region and the lateral portion of the forward lower portion of the subframe occurs when the engagement region 48 is imparting a force upon the forward portion of the trigger guard 27 (see FIG. 4).

Now referring to FIG. 7, the gun attachment 20 further comprises a central chamber region 56. The chamber region 56 has a lower surface 59, a first lateral surface 60 and a second lateral surface 62 (see FIG. 8) opposite to surface 60 and not shown in FIG. 7. The chamber region 56 is adapted to house a forward lower portion of the subframe 29 of a firearm as shown in FIG. 4. The lower surface 58 is adapted to forcefully engage the lower surface of the forward lower portion of the subframe 29 as described below.

Now referring to FIGS. 3 and 4, the gun attachment 20 is attached to the firearm 21. The member 23 extends through the firearm and provides the functionality that is inherent with the placement of the pin and further, the pin extends through the portion of the shoulders 40 to provide a first mounting region of the mounting system 34. Located vertically below the first mounting system, the engagement portion 48 engages the trigger guard 27 of the firearm 21. As shown in FIG. 4, because the engagement force indicated at 52 is vertically below the force exerted upon the firearm at the laterally extending member 23 by a distance indicated by 57, a movement in the direction indicated by arrow 58 is produced. This provides a thrust force upon the lower portion of the forward lower portion of the subframe 29 from the chamber region 56 of the attachment 20.

It should be noted that any laterally extending pin would suffice to provide a first connection region for the firearm. In some cases the pin is not replaced if the pin naturally extends laterally beyond the side lateral surfaces of the subframe 35. However, in most installations the laterally extending pin of the handgun 21 is replaced with a new pin that is longer. In one form it is advantageous to use a material for the member 23 that is harder and hence more likely to shear than bend. This material property is advantageous in the situation where a heavy impact is imparted upon the attachment 20. When the pins shear off between the attachment 20 and the subframe 35 of the handgun, the handgun is still operable and functions in a similar manner as when the gun attachment is removed and the original pins are inserted therethrough the gun 21. In other words the laterally extending pin still holds the various components of the handgun together even though the extreme lateral members are sheared off. At a later time the sheared pin can be removed by a punch and replaced. As shown in FIG. 9, a lateral interface location is defined as indicated at 123. The lateral interface location 123 is the area of engagement between the laterally inward surface 121 of the shoulder region 40 and the laterally outward surface of the handgun positioned on the subframe. The lateral interface location 123 is the point of shear whereby the laterally extending pin is designed to fail and keep the firearm operational even though the gun attachment will now presumably fall or otherwise be jerked off by the handgun during the course of the recoil if the handgun is fired. However, it should be reiterated that the incising shear action without bending the laterally extending pin allows the handgun to be operational even thought the strike plate is no longer supported.

There will now be a discussion of the reinforcement region 38 referring to FIG. 1. As shown in these figures, the reinforcement region 38 is located in the forward region 22. The reinforcement region has an inner surface 61 that defines an opening 63. The opening is adapted to allow the bullet projectile from the firearm to pass therethrough unobstructed. The opening 63 allows the channeled gases to pass and present analysis indicates that the opening functions to relieve pressure off the projectile as the projectile passes at a high rate of velocity. In one form the inner surface 61*a* is adapted to engage the bushing 19 of the handgun 21 as shown in FIG. 3. It has been found that this inner surface 61 a as shown in FIG. 1 can build up residue form the combusted material after firing rounds where the bushing lock up provides a more rigid lock up to the slide. This is particularly advantageous for slides that do not have a tight fit loose accuracy. It has been found that over 17,000 .45 caliber rounds have been fired through a Para-Ordinance P-14 with the gun attachment attached thereto without any cleaning of the surface 61*a* as shown in FIG. 3. Present analysis indicated that bushing appeared to be fitted to the gun attachment when the handgun was in battery with this residue build up. Further, there appeared to be no issue of the gun not returning to battery due to the build up even though such a high volume of rounds passed therethrough.

The inner surfaces 61 and 61*a* are positioned in a vertical wall 64 that has a front surface 70. The reinforcement region 38 is rigidly formed the base member in one form is integral therewith and made from a solid block of material such as aluminum.

Now referring to FIG. 2, the front surface 70 is adapted to engage foreign objects that can potentially interfere with the operation of the firearm. The enforcement region 38 operates to protect the slide 33 of the firearm from being knocked out of battery. One common problem with slide-operated handguns is that if the slide 33 is repositioned rearwardly with respect to the lower subframe 35, the gun will not fire. It has been known in law enforcement and self-defense tactics that depressing the forward region of a gun prior to pulling the trigger can render the gun temporarily inoperable. Therefore, because the gun attachment 20 is mounted to the subframe 35 and not to the movable slide, the enforcement region 38 will deliver the force to the subframe 35 from an impact from a foreign object and not allow the force to be transmitted to the slide 33. As mentioned above it should be reiterated that when any impact is imparted upon the reinforcement region 38, the load is distributed to the subframe 35 through the pins 23 and additionally through the trigger guard 27 by the engagement portion 48. If the force is sufficiently large to shear the member 23, then the gun is still operable.

Figure 6:
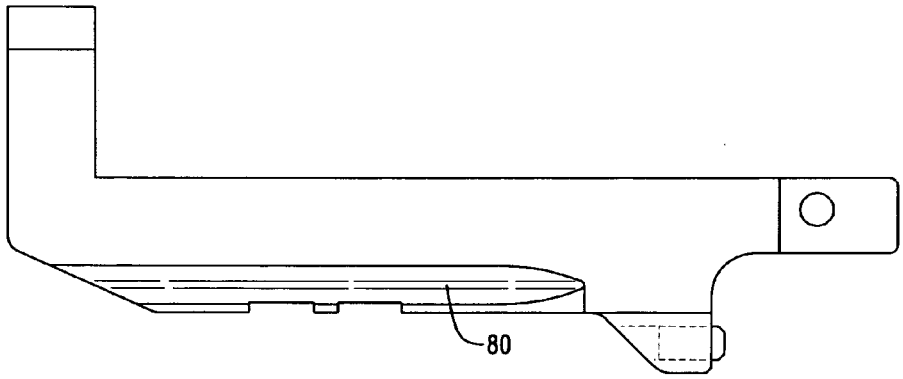
FIG. 6 is another side view of the gun attachment.
Figure 10:
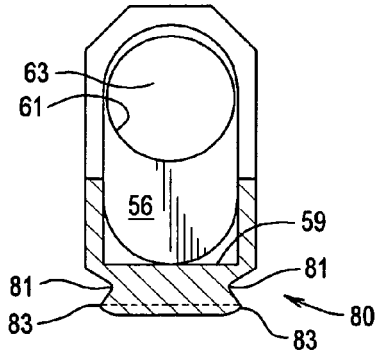
FIG. 10 is a sectional view taken along line 10—10 of FIG. 5 of the base member showing cross-sectionally one form of the attachment system.
Figure 11:
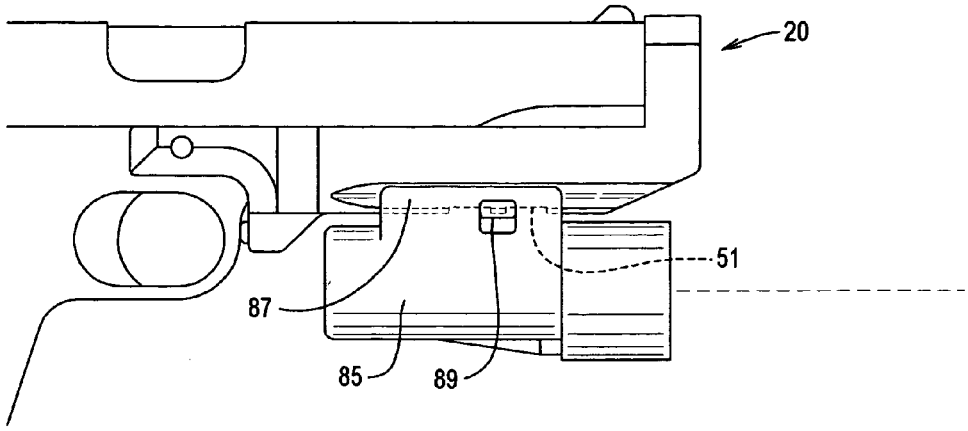
FIG. 11 shows an attachment to the attachment system which in one form is a flashlight attachment.

There will now be a discussion of the attachment region 36 with reference to FIGS. 6 and 10. As shown in these figures, the attachment region 36 has a longitudinally extending slotted region 80 that is adapted to mount to various attachments to a firearm. One form of the slot is dovetail alignment and the derivatives such as a picatinny rail system that has a custom width and flange to allow an assortment of attachments to be attached thereto. For example, attachments such as lasers, flashlights, and infrared illuminators can be attached to assist the operator of the firearm to in executing his or her duties. The light, which is one form of external paraphernalia as shown in FIG. 11, can be a regular incandescent light or an infer-red type light of various electromagnetic frequencies, which is particularly conducive for night vision applications where the operator is wearing a night vision type optical device. Further, the illumination source from the external paraphernalia can be an LED type of light, or any other device to provide illumination. As shown in FIG. 10, the longitudinally extending slotted region 80 has surfaces 81 defining a lower laterally outward region 83 that is well suited for applying a load thereto and having a solid surface that accurately and repeatedly aligns any attachment.

It should be noted that the picatinny rail standard dates back to the early part of the 20$^{th}$ century, whereby various deviations, change in tolerances, and positioning of certain surfaces are derived from this standard. Therefore, the standard is defined broadly to generally define the laterally extending slots that are adapted to receive a majority of items adapted to fit a rail. The attachment region can be adapted to other standards such as standards such as methods that include pivot locking members on the paraphernalia to forcefully engage the attachment region.

As shown in FIG. 5, a flash light attachment 85 has an upper portion 87 that matches the contour as shown a lower part of FIG. 10 of the longitudinally extending slotted region 80. In general, the attachments such as the light 85 in FIG. 11 are well suited for attaching to any picatinny rail system. Of course other standard rail systems can be employed; however, the picatinny rail system is very common. Many newer firearms have a lower picatinny rail directly mounted to the subframe of the handgun. However, there are numerous handguns without such a fitting molded therein. For example, one of the most popular handguns in the world is the government model 1911 that has a lower dust cover (or forward lower portion of the subframe), and the vast majority of these handguns do not have a picatinny or other type of rail mounted system to the subframe to allow attachments to be applied thereto. Therefore, the gun attachment 20 allows for the adaptation of the attachment region 36 and further the reinforcement region 38 to prevent the handgun 20 from being knocked out of battery.

As shown in FIG. 11, the light attachment 85 has a locking mechanism 89 that consists of a spring-loaded member that is adapted to engage the laterally extending slots 51. The laterally extending slots 51 have surfaces 53 and 55 as shown in FIG. 4 that are adapted to engage vertical surfaces of the locking mechanism 89 as shown in FIG. 11 to prevent longitudinal movement of the attachment such as that as shown in FIG. 11 with respect to the gun attachment 20.

Figure 12:
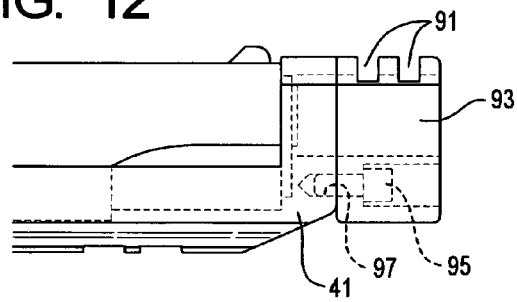
FIG. 12 shows a side view of the compensator attachment adapted to be mounted to the forward portion of the gun attachment.
Figure 13:
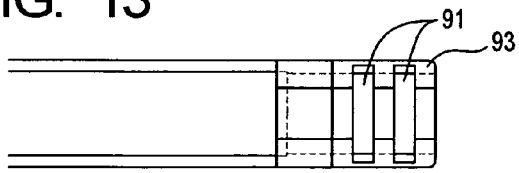
FIG. 13 is a top view of the compensator attachment.
Figure 14:
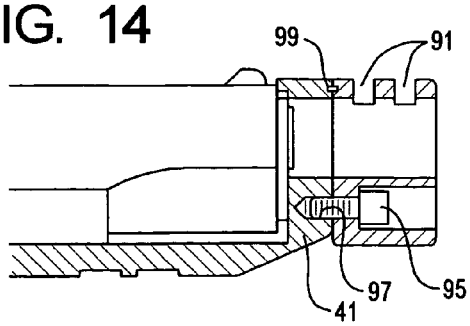
FIG. 14 is a partial sectional view of the forward portion of the gun attachment and the compensator attachment illustrating one mode of attaching the compensator to the forward portion of the base member.

Now referring to FIGS. 12–14, an optional variation of the reinforcement region 38 is to allow for surfaces defining vertically extending slots 91 that are located on the upper portion of the compensator attachment 93. The slots are located approximately at the upper portion of the compensator attachment 93 and allow for gas to channel therethrough to exit vertically providing a vertical outlet, thereby reducing muzzle lift. Any common compensating slot system can be employed by those skilled in the art. The compensator attachment 93 as shown in FIGS. 12 and 14 can be attached to the base member 41 by an attachment screw 95 that is adapted to be received by a surface defining a recessed region 97 and a lower front portion of the vertical wall 64. The attachment screw can have a forward region that extends from the front surface of the suppressor 93 and have a pointed hardened member similar to that of the punch 90 in FIG. 16. Referring back to FIGS. 12–14, the compensator attachment 93 can further have an alignment pin 99 that is adapted to engage a recessed region somewhere within the front surface of the base member 41 for proper alignment and position of the compensator attachment 93 with respect to the base member 41.

Figure 15:
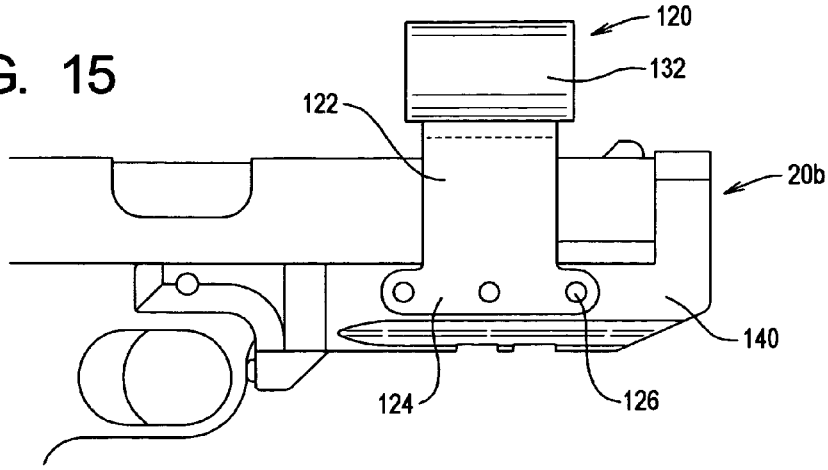
FIG. 15 shows one embodiment where an auxiliary item is attached to the lateral portion of the gun attachment wherein, in one form, the upper portion is a mount for an optic such as a red dot scope.

FIG. 15 shows a modification to the gun attachment 20*b* whereby the lateral regions of the gun attachment 20*b* are adapted to fit an optic mount 120. The optic mount comprises a base region 122 having a lower portion 124 with mounting elements 126 that are adapted to mount to the gun attachment 20*b*. The arms 128 and 130 can both be employed, or alternatively, a single arm can be employed for a base region. The upper portion of the optic mount 120 has a platform for mounting an optical device that is adapted to be mounted in the mounting region indicated at 132 above the slide of the gun. In one form, the region 132 repositions laterally inwardly and has an inner conical surface with a center that is substantially in line with the bore of the barrel and positioned substantially vertically thereabove.

In a further embodiment, a railing system that is similar to the attachment region 36 (such as a dovetail/picatinny rail standard) can be added to the side lateral region 140. This allows for additional attachments to be attached thereto. Further, in the embodiment as shown in FIG. 15 the mounting elements 126 of the optical mount can be attached to this similar style of mounting system such as the mounting system 87 and 89 of the light the attachment 85 as shown in FIG. 11. This can provide for an easy attachment and disengagement of the optics.

Figure 16:
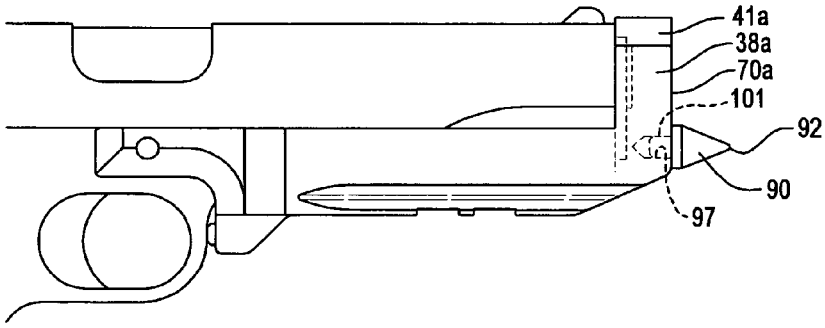
FIG. 16 shows another embodiment where a punch member is attached to the forward portion of the base member.

Now referring to FIG. 16, another embodiment is shown whereby the reinforcement region 38*a* has an impact punch 90. The impact punch is adapted to be mounted to the front surface 70*a* of the reinforcement region 38*a*. The impact punch 90 has a forward region 92 of relatively small surface area to provide a high-pressure impact pressure with a modest amount of force. The base member 41*a* as shown in FIG. 16 can be similar to the base member 41 as shown in FIG. 14 whereby the inner cavity surface 97 defines similar style threads to engage corresponding male threads 101 of the impact punch 90. In one form, the impact punch is made of a hardened material which is unyielding and provides high pressure when impacted upon surfaces, particularly those consisting of brittle materials.

Figure 17:
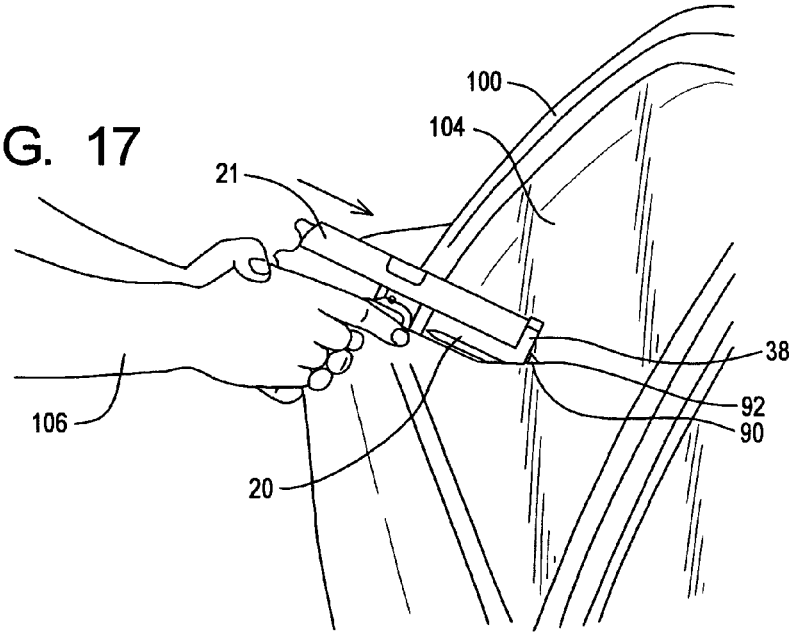
FIG. 17 illustrates one method of breaking a brittle material such as glass which in one form where the gun attachment is used to apprehend a hostile suspect in an environment such as within a car where the operator of the handgun with the gun attachment attached thereto can break the glass without sacrificing his or her tactical advantage.

Now referring to FIG. 17, the impact punch 90 is particularly useful for the tactical operation of shattering a window. A police officer, a security officer or other law enforcement personnel oftentimes may have to approach a vehicle with a gun drawn in a potentially hostile situation. If the driver or passenger residing behind a glass window is noncompliant, oftentimes a law enforcement officer must break the glass to get inside the vehicle and apprehend a suspect or person of interest. A prior art method of accomplishing this consists of the individual transffering the firearm from his or her strong hand to his or her weak hand, grasping a rigid member such as a flashlight or baton and withdrawing it from his or her utility belt, and then striking the window several times with the rigid member until the window breaks. Thereafter, the law enforcement officer must reposition the baton back to his or her utility belt and reposition the firearm to his or her strong hand.

This process requires many steps and is prone to causing undesirable incidents and accidents. Further, after striking the window, the suspect may act in retaliation and the law enforcement officer would not be in a proper position to respond accordingly. When the officer switches the firearm to his weak hand, he is switching the point of dominance to the potential suspect where he is no longer in a position of strength of his highest proficiency levels.

The embodiment as shown in FIG. 16 is particularly advantageous for such a situation described above. As shown in FIG. 17, there is a vehicle 100 where a suspect (not shown) is behind a window 104. The law enforcement officer indicated at 106 is holding a firearm 21 with the attachment 20 attached thereto. When the individual 102 is noncompliant with the officer, the officer can bow his arms as indicated in FIG. 10, place his trigger finger off the trigger alongside the frame of the firearm 21, and as shown in FIG. 17, strike the window with the reinforcement region 38 of the attachment 20. The second embodiment is particularly advantageous for breaking the window whereby the point region 92 of the impact punch 90 provides a very high-pressure blow which is well adapted for breaking brittle materials such as glass.

After the officer has broken the glass, he or she can reposition his or her firearm and use it accordingly if necessary. It should be noted that the officer does not have to take his or her sight index off of the suspect during this operation; the sight index may remain at the suspect's vital target regions. Alternately, the officer can strike the window with the muzzle point slightly away from the suspect. After the window has broken, the officer only has to place his or her trigger finger upon the trigger as required to operate the firearm if needed. This operation can be employed without the center punch because the gun attachment 20 transfers force to the subframe 35 and maintains functionality of the firearm; however, the center punch is helpful for breaking glass.

Figure 18:
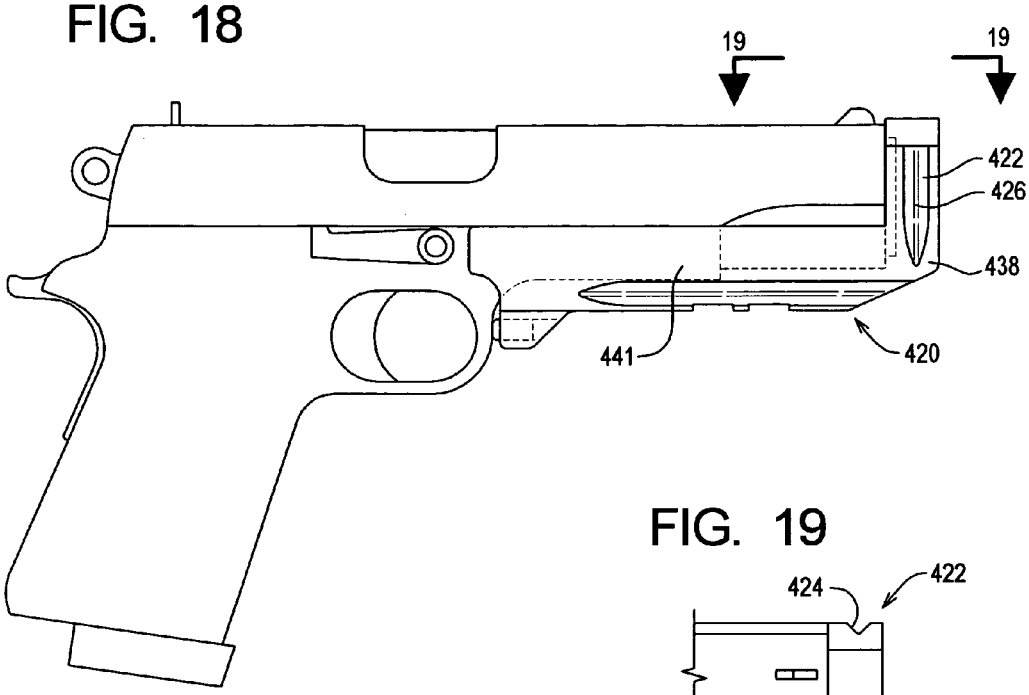
FIG. 18 is a side view of another embodiment of the gun attachment whereby the forward portion is adapted to fit a suppressor adapter thereto.
Figure 19:
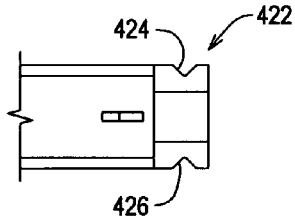
FIG. 19 is a top view of the forward portion of the base member.
Figure 20:
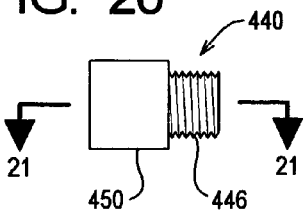
FIG. 20 is a side view of the suppressor adapter adapted to fit to the forward portion of the base member.

There will now be a discussion of a suppressor adapter 440 as shown in FIG. 20. In general, the suppressor adapter is adapted to quickly mount to the forward region of the base member 441 that is shown in FIG. 18. FIG. 18 shows this additional embodiment whereby the gun attachment 420 comprises a slot system 422 positioned on the reinforcement region 438. As shown in FIG. 19, there is a top view of the slot system 422 where laterally positioned surfaces 424 and 426 define a recess region that is adapted to engage the laterally inward extensions 428 and 430 as shown in FIG. 21 of the suppressor adapter 440.

The suppressor adapter 440 as shown in FIG. 20 has a forward region which in one form has surfaces defining threads 446 where the male threads are adapted to threadedly engage corresponding female threads of a suppressor or the like. As shown in FIG. 20, the suppressor adapter 440 has a lower rearward region 450 that has a lower open portion that exposes the laterally inward extensions 428 and 430 as cross-sectionally shown in FIG. 21.

Figure 21:
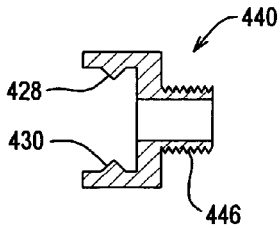
FIG. 21 is a cross sectional view of the suppressor adapter taken along line 21—21 of FIG. 20.

In one form of fitting the suppressor adapter 440 to the base member 441 is to position the adapter 440 in a manner as shown in FIG. 20 and aligning the laterally inward extensions 428 and 430 (as shown in FIG. 21) with the laterally inward slots 424 and 426. After the alignment the adapter 440 is positioned downwardly with respect to the base member 441 so the central opening of the inner cavity of the attachment member is substantially in line with the barrel. Of course other methods of attaching a suppressor can be employed without departing from the spirit and scope of the utility of the adapter. It should be noted that a suppressor could be integral with the adapter 440, whereby it is not threaded thereto but is permanently attached or otherwise fixed and operationally engaged to the adapter to function as one.

Figure 22:
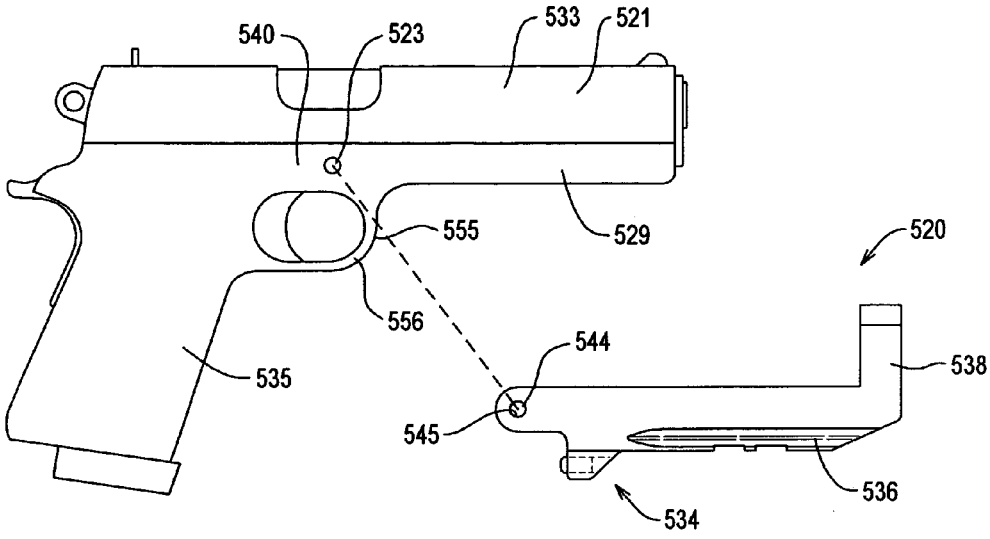
FIG. 22 shows another embodiment of the gun attachment.

Now referring to FIG. 22, there is shown another embodiment of the gun attachment 520 whereby the firearm 521 has a subframe 535 which comprises a lower forward portion 529. The lower forward portion 529 in one form has a generic exterior surface that does not conform to any rail standard. This is particularly the case with older firearms that were not produced within the past few years previous to this writing. The firearm has an opening adapted to have a laterally extending member 523 extending therethrough. This particular firearm laterally extending member is a crosspin adapted to house the trigger assembly and maintain the relative relationship of the components relating to the trigger and other mechanisms therein. This laterally extending member can be replaced with one that extends slightly longer than the immediate adjacent surface indicated at 540 and, in a similar manner as described above, this replaced laterally extending member is adapted to extend through the engagement region 544 as shown in the lower right hand portion of FIG. 22. The engagement region in this form has inner cylindrical surface 545 that is adapted to receive the extended pin 523. The other components of the attachment 520 function similarly as described above in that the engagement portion 534 operates in a similar manner, engaging the front surface 555 of the trigger guard 556. Further, in the preferred form, there is an attachment region 536 and a reinforcement region 538 adapted to receive loads impacted thereon, and transmit such loads to the slide 533 of the handgun 535. These portions are similar to the embodiment 620 as shown in the following FIG. 23.

Figure 23:
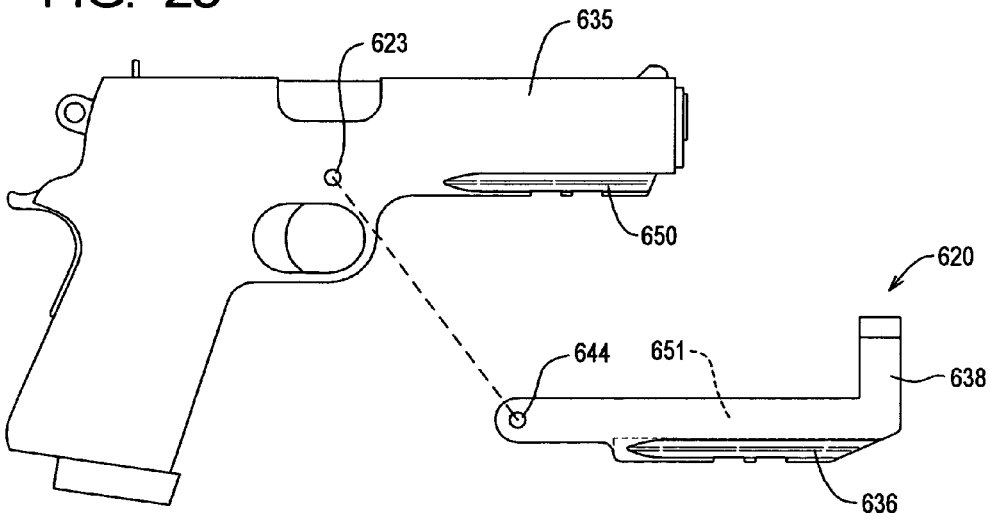
FIG. 23 shows yet another embodiment of the gun attachment.

Embodiment 620 is shown in FIG. 23 has similar components to those described in the embodiments above, including an engagement region 644, an attachment region 636 and the reinforcement region 638. The handgun 635 has a rail system 650, which one form is a picatinny style rail. Therefore, the gun attachment 620 has an interior chamber 651 that is adapted to have a negative imprint of this rail system and engage thereto along the longitudinal axis of the gun 635. In other words, to attached the gun attachment 620 it must be repositioned at the forward region of the gun and slid rearwardly to engage the rail system 650. Thereafter, in one form, a reinforcement member that is laterally extending indicated at 623 engages the opening 644 to further securely lock the gun attachment 620 to the handgun 635. This embodiment may or may not have the extension member such as a set screw engage the trigger guard.

Figure 24A:
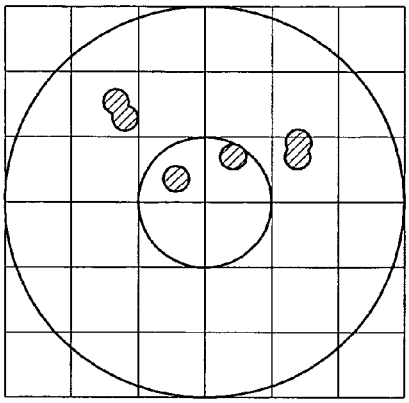
FIGS. 24A–24D shows actual target groups by the same shooter with the gun attachment attached in FIGS. 24B and 24D as well as a set of groupings in FIGS. 24A and 24C where the gun attachment was not attached to the handgun.
Figure 24B:
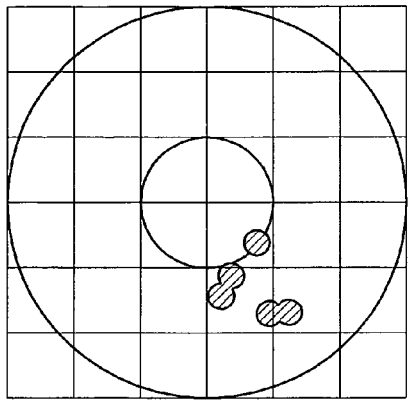
Figure 24C:
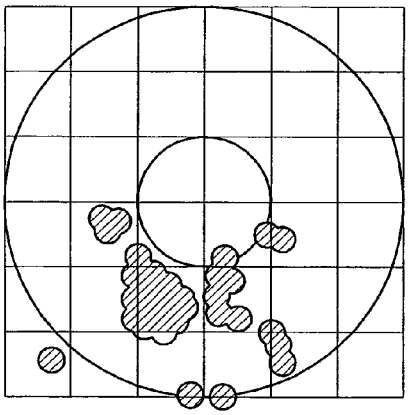
Figure 24D:
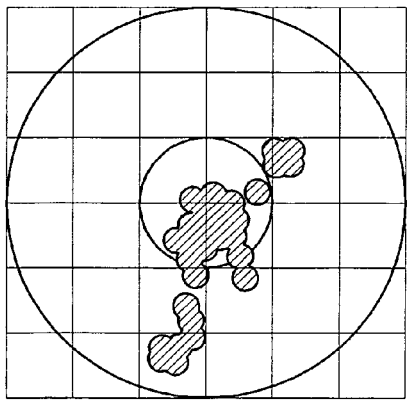

Now referring to FIGS. 24A–24D, FIG. 24A shows a fair and accurate representation of a shot grouping of five shots fired by a former female Olympic team member for bullseye shooting without the attachment 20. FIG. 24B shows a second grouping at the same distance (20 yards) with the attachment 20 employed to the same gun. As you can see, the groupings in FIG. 24B are much tighter than those in FIG. 24C. Now referring to FIG. 24C, the same shooter fired 20 shots at 20 yards without the attachment 20 attached to the firearm. Thereafter, after attaching the attachment 20 to the firearm, the groupings are shown in FIG. 24D. It should be noted that 30 shots were fired in FIG. 24D with the attachment and the groups are substantially smaller than in FIG. 24C. It should also be noted that nothing was changed between any of the groups fired in FIGS. 24A–24D except for adding the assembly 20 to the handgun (FIGS. 24A and 24C are without the attachment 20 and FIGS. 24B–24D are with the attachment 20 employed).

Of course various modifications and alterations can be performed without departing from the spirit and scope of the claimed invention.

I claim:

1. A gun attachment adapted to be fitted to a handgun having a vertical, longitudinal and lateral axis and a subframe and a slide, the handgun having a laterally extending member and a trigger guard, the gun attachment being adapted to maintain the slide in battery when an external force is applied thereto, the gun attachment comprising:

a) a locking system having an extension member having a forward surface that is adapted to engage the trigger guard of the handgun, an engagement surface adapted to positionally engage the laterally extending member, b) a base region comprising a slotted surface defining an open region adapted to engage the subframe of the handgun, c) a forward member extending vertically having a forward engagement surface adapted to have the external force applied thereto and transfer the energy of said force to the subframe of the handgun, d) whereas the extension member is adapted to move with respect to the base region and forcefully engage the trigger guard to provide a positive torque whereby the slotted surface forcefully engages the subframe and the gun attachment adapted to be rigidly attached to the handgun and if said external force is applied to the forward member of the gun attachment in the longitudinal direction, said external force is transferred to the subframe of the handgun whereby maintaining the slide of the handgun in battery.

2. The gun attachment as recited in claim 1 whereby a lower portion of the gun attachment defines an attachment region having laterally positioned slotted regions adapted to receive external paraphernalia.

3. The gun attachment as recited in claim 2 whereby the attachment region comprises laterally positioned surfaces defining slot regions where said slot regions are adapted to engage a corresponding negative imprint of such regions for receiving such external paraphernalia.

4. The gun attachment as recited in claim 2 whereby the external paraphernalia consists of a light.

5. The gun attachment as recited in claim 4 where the external paraphernalia consists of a laser.

6. The gun attachment as recited in claim 1 whereby the forward member has an inner surface that is adapted to have residue build up form thereon from discharged rounds and this residue build up is adapted to engage the bushing of the handgun when the hand gun is in battery.

7. The gun attachment as recited in claim 2 where the attachment region defines a rail system adapted to the picantinny standard.

8. The gun attachment as recited in claim 6 whereby the forward region has a punch member attached thereto.

9. The gun attachment as recited in claim 1 whereby the forward member is adapted to have a suppressor mounted thereto.

10. The gun attachment as recited in claim 1 whereby the handgun requires no permanent modifications thereto for retrofitting the gun attachment thereto.

11. The gun attachment as recited in claim 2 whereby the handgun requires no permanent modifications thereto for retrofitting the gun attachment thereto.

12. The gun attachment as recited in claim 1 whereby an intermediate member is mounted to the forward member, the intermediate member having a forward region adapted to have a suppressor mounted thereto.

13. The gun attachment as recited in claim 1 whereby the forward region has a punch member attached thereto.

14. The gun attachment as recited in claim 1 whereby the forward member is adapted to engage a person and allow the firing of a projectile from the gun while the forward member is in forceful engagement with said third person.

15. The gun attachment as recited in claim 2 whereby the forward member is adapted to engage a person and allow the firing of a projectile from the gun while the forward member is in forceful engagement with said third person.

16. A handgun attachment adapted to be fitted to a handgun having a subframe having a forward lower portion, a slide, a trigger guard, muzzle and a laterally extended member, the handgun attachment adapted to transmit external force that directed toward a muzzle region of the gun to the subframe, the handgun attachment comprising:

a) a base member having a forward section and a rearward section, a mounting region located in the rearward section where a locking system is positioned and comprises an extension member adapted to extend longitudinally rearwardly and engage the trigger guard of the handgun to forcefully apply pressure thereto, the mounting region of the base member further comprising a receiving portion adapted to engage the laterally extending member of the handgun, the base member having a longitudinally forward region with a lower surface and first and second lateral surfaces defining a chamber region that is adapted to engage the subframe of the handgun, the base member further comprising a reinforcement region rigidly formed to the base member and positioned in the forward section and extending in front of the muzzle of the handgun, b) whereas the extension member is positioned vertically below the point of engagement of the receiving portion whereby the extension member is adapted to apply a force to the trigger guard of the handgun creating a torque substantially about a lateral axis and forcefully engaging the lower surface to the forward lower portion of the subframe of the handgun, and further the reinforcement region is adapted to transmit the external force exerted upon the reinforcement region to the subframe and not to the slide of the handgun whereby maintaining the slide in battery.

17. The handgun attachment as recited in claim 16 whereby the laterally extending member is made of a material so an excessive shearing force will shear the laterally extending member at a lateral interface location between the base member and a lateral surface region of the handgun.

18. The handgun attachment as recited in 17 whereby the shear force that is sufficient to shear the laterally extending member is less than the sufficient force applied to the subframe through the laterally extending member to damage the subframe.

19. The handgun attachment as recited in claim 16 whereby the gun attachment further comprises a suppressor adapter adapted to be fitted to the reinforcement region of the base member where the suppressor attachment has a forward region adapted to engage a suppressor.

20. The handgun attachment as recited in claim 16 whereby the first and second lateral walls are adapted to engage lateral regions of the subframe of the handgun and stabilize the base member.

21. The handgun attachment as recited in claim 16 whereby the base member comprises surfaces defining an attachment system that is adapted to have external paraphernalia attached thereto.

22. The handgun attachment as recited in claim 21 whereby one form of external paraphernalia is a gun light adapted to be mounted to an attachment system that conforms to a picatinny style rail.

23. The handgun attachment as recited in claim 16 whereby an optic mount is attached to the base member and provides a mounting region that is positioned above the slide of the handgun and adapted to have an optic rigidly mounted thereto.

* * * * *